US009847066B2

(12) United States Patent
Cho

(10) Patent No.: US 9,847,066 B2
(45) Date of Patent: Dec. 19, 2017

(54) METHOD OF OPERATING DISPLAY PANEL AND DISPLAY APPARATUS PERFORMING THE SAME

(71) Applicant: Samsung Display Co., Ltd., Yongin (KR)

(72) Inventor: Dong-Beom Cho, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 181 days.

(21) Appl. No.: 14/734,767

(22) Filed: Jun. 9, 2015

(65) Prior Publication Data

US 2016/0140916 A1 May 19, 2016

(30) Foreign Application Priority Data

Nov. 14, 2014 (KR) ..... 10-2014-0159173

(51) Int. Cl.
*G09G 3/36* (2006.01)

(52) U.S. Cl.
CPC ... *G09G 3/3648* (2013.01); *G09G 2320/0252* (2013.01); *G09G 2320/0285* (2013.01); *G09G 2340/16* (2013.01)

(58) Field of Classification Search
CPC ... G09G 3/36; G09G 5/00; G09G 5/02; G06F 3/038; G06K 9/46
See application file for complete search history.

(56) References Cited

U.S. PATENT DOCUMENTS

| | | | | |
|---|---|---|---|---|
| 6,756,955 | B2 * | 6/2004 | Someya | G09G 3/2011 345/604 |
| 7,710,385 | B2 | 5/2010 | Lee et al. | |
| 8,004,482 | B2 | 8/2011 | Lee et al. | |
| 2003/0231158 | A1 * | 12/2003 | Someya | G09G 3/3611 345/101 |
| 2013/0169619 | A1 * | 7/2013 | Jeong | G09G 5/001 345/212 |

FOREIGN PATENT DOCUMENTS

| | | |
|---|---|---|
| JP | 2007-108668 | 4/2007 |
| KR | 10-2007-0121972 | 12/2007 |
| KR | 10-1419222 | 2/2009 |
| KR | 10-2009-0129214 | 12/2009 |

* cited by examiner

*Primary Examiner* — Pegeman Karimi
(74) *Attorney, Agent, or Firm* — H.C. Park & Associates, PLC

(57) ABSTRACT

A method of operating a display panel in which a plurality of decisions are generated by detecting transitions of a plurality of present pixel data included in a present frame image. A uniform dynamic capacitance compensation (DCC) is performed based on the plurality of decisions. A present grayscale of each of the plurality of present pixel data increases by a first compensation value, decreases by a second compensation value, or is maintained based on the uniform DCC.

16 Claims, 9 Drawing Sheets

FIG. 8A

| GB \ GA | 0 | 64 | 128 | 192 | 256 | 320 | 384 | 448 | 512 | 576 | 640 | 704 | 768 | 832 | 896 | 960 | 1023 |
|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 |
| 64 | 164 | 64 | 0 | 0 | 0 | 0 | 0 | 0 | 0 | 0 | 0 | 0 | 0 | 0 | 0 | 0 | 0 |
| 128 | 228 | 228 | 128 | 28 | 28 | 28 | 28 | 28 | 28 | 28 | 28 | 28 | 28 | 28 | 28 | 28 | 28 |
| 192 | 292 | 292 | 292 | 192 | 92 | 92 | 92 | 92 | 92 | 92 | 92 | 92 | 92 | 92 | 92 | 92 | 92 |
| 256 | 356 | 356 | 356 | 356 | 256 | 156 | 156 | 156 | 156 | 156 | 156 | 156 | 156 | 156 | 156 | 156 | 156 |
| 320 | 420 | 420 | 420 | 420 | 420 | 320 | 220 | 220 | 220 | 220 | 220 | 220 | 220 | 220 | 220 | 220 | 220 |
| 384 | 484 | 484 | 484 | 484 | 484 | 484 | 384 | 284 | 284 | 284 | 284 | 284 | 284 | 284 | 284 | 284 | 284 |
| 448 | 548 | 548 | 548 | 548 | 548 | 548 | 548 | 448 | 348 | 348 | 348 | 348 | 348 | 348 | 348 | 348 | 348 |
| 512 | 612 | 612 | 612 | 612 | 612 | 612 | 612 | 612 | 512 | 412 | 412 | 412 | 412 | 412 | 412 | 412 | 412 |
| 576 | 676 | 676 | 676 | 676 | 676 | 676 | 676 | 676 | 676 | 576 | 476 | 476 | 476 | 476 | 476 | 476 | 476 |
| 640 | 740 | 740 | 740 | 740 | 740 | 740 | 740 | 740 | 740 | 740 | 640 | 540 | 540 | 540 | 540 | 540 | 540 |
| 704 | 804 | 804 | 804 | 804 | 804 | 804 | 804 | 804 | 804 | 804 | 804 | 704 | 604 | 604 | 604 | 604 | 604 |
| 768 | 868 | 868 | 868 | 868 | 868 | 868 | 868 | 868 | 868 | 868 | 868 | 868 | 768 | 668 | 668 | 668 | 668 |
| 832 | 932 | 932 | 932 | 932 | 932 | 932 | 932 | 932 | 932 | 932 | 932 | 932 | 932 | 832 | 732 | 732 | 732 |
| 896 | 996 | 996 | 996 | 996 | 996 | 996 | 996 | 996 | 996 | 996 | 996 | 996 | 996 | 996 | 896 | 796 | 796 |
| 960 | 1023 | 1023 | 1023 | 1023 | 1023 | 1023 | 1023 | 1023 | 1023 | 1023 | 1023 | 1023 | 1023 | 1023 | 1023 | 960 | 860 |
| 1023 | 1023 | 1023 | 1023 | 1023 | 1023 | 1023 | 1023 | 1023 | 1023 | 1023 | 1023 | 1023 | 1023 | 1023 | 1023 | 1023 | 1023 |

FIG. 8B

| GB \ GA | 0 | 64 | 128 | 192 | 256 | 320 | 384 | 448 | 512 | 576 | 640 | 704 | 768 | 832 | 896 | 960 | 1023 |
|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 |
| 64 | 164 | 64 | 0 | 0 | 0 | 0 | 0 | 0 | 0 | 0 | 0 | 0 | 0 | 0 | 0 | 0 | 0 |
| 128 | 228 | 228 | 128 | 48 | 48 | 48 | 48 | 48 | 48 | 48 | 48 | 48 | 48 | 48 | 48 | 48 | 48 |
| 192 | 292 | 292 | 292 | 192 | 112 | 112 | 112 | 112 | 112 | 112 | 112 | 112 | 112 | 112 | 112 | 112 | 112 |
| 256 | 356 | 356 | 356 | 356 | 256 | 176 | 176 | 176 | 176 | 176 | 176 | 176 | 176 | 176 | 176 | 176 | 176 |
| 320 | 420 | 420 | 420 | 420 | 420 | 320 | 240 | 240 | 240 | 240 | 240 | 240 | 240 | 240 | 240 | 240 | 240 |
| 384 | 484 | 484 | 484 | 484 | 484 | 484 | 384 | 304 | 304 | 304 | 304 | 304 | 304 | 304 | 304 | 304 | 304 |
| 448 | 548 | 548 | 548 | 548 | 548 | 548 | 548 | 448 | 368 | 368 | 368 | 368 | 368 | 368 | 368 | 368 | 368 |
| 512 | 612 | 612 | 612 | 612 | 612 | 612 | 612 | 612 | 512 | 432 | 432 | 432 | 432 | 432 | 432 | 432 | 432 |
| 576 | 676 | 676 | 676 | 676 | 676 | 676 | 676 | 676 | 676 | 576 | 496 | 496 | 496 | 496 | 496 | 496 | 496 |
| 640 | 740 | 740 | 740 | 740 | 740 | 740 | 740 | 740 | 740 | 740 | 640 | 560 | 560 | 560 | 560 | 560 | 560 |
| 704 | 804 | 804 | 804 | 804 | 804 | 804 | 804 | 804 | 804 | 804 | 804 | 704 | 624 | 624 | 624 | 624 | 624 |
| 768 | 868 | 868 | 868 | 868 | 868 | 868 | 868 | 868 | 868 | 868 | 868 | 868 | 768 | 688 | 688 | 688 | 688 |
| 832 | 932 | 932 | 932 | 932 | 932 | 932 | 932 | 932 | 932 | 932 | 932 | 932 | 932 | 832 | 752 | 752 | 752 |
| 896 | 996 | 996 | 996 | 996 | 996 | 996 | 996 | 996 | 996 | 996 | 996 | 996 | 996 | 996 | 896 | 816 | 816 |
| 960 | 1023 | 1023 | 1023 | 1023 | 1023 | 1023 | 1023 | 1023 | 1023 | 1023 | 1023 | 1023 | 1023 | 1023 | 1023 | 960 | 880 |
| 1023 | 1023 | 1023 | 1023 | 1023 | 1023 | 1023 | 1023 | 1023 | 1023 | 1023 | 1023 | 1023 | 1023 | 1023 | 1023 | 1023 | 1023 |

METHOD OF OPERATING DISPLAY PANEL AND DISPLAY APPARATUS PERFORMING THE SAME

CROSS-REFERENCE TO RELATED APPLICATION

This application claims priority from and the benefit of Korean Patent Application No. 10-2014-0159173, filed on Nov. 14, 2014, which is hereby incorporated by reference for all purposes as if fully set forth herein.

BACKGROUND

Field

Exemplary embodiments relate generally to display apparatuses. More particularly, exemplary embodiments relate to methods of operating display panels and display apparatuses performing the methods.

Discussion of the Background

A liquid crystal display (LCD) apparatus may include a first substrate including a pixel electrode, a second substrate including a common electrode, and a liquid crystal layer disposed between the first and second substrates. An electric field may be generated by voltages applied to the pixel electrode and the common electrode. An intensity of the electric field may be adjusted to control transmittance of light passing through the liquid crystal layer, and thus, a desired image may be displayed.

A dynamic capacitance compensation (DCC), which is a method for compensating grayscales of present frame image data based on previous frame image data and the present frame image data, may be employed to improve the response speed of the LCD apparatus. To perform the DCC, the LCD apparatus includes a memory that stores the previous frame image data, and thus, a size and the manufacturing cost of the LCD apparatus may increase.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide a method of operating a display panel capable of improving the response speed without increasing a size and the manufacturing cost.

Exemplary embodiments also provide a display apparatus configured to perform the method of operating the display panel.

Additional aspects will be set forth in the detailed description which follows, and, in part, will be apparent from the disclosure, or may be learned by practice of the inventive concept.

An exemplary embodiment of the present invention discloses a method of operating a display panel, in which a plurality of decisions are generated by detecting transitions of a plurality of present pixel data included in a present frame image. A uniform dynamic capacitance compensation (DCC) is then performed based on the plurality of decisions. A present grayscale of each of the plurality of present pixel data increases by a first compensation value, decreases by a second compensation value, or is maintained based on the uniform DCC.

An exemplary embodiment of the present invention also discloses a display apparatus including a display panel, a data driver and a timing controller. The display panel includes a plurality of pixels that are connected to a plurality of gate lines and a plurality of data lines. The data driver generates a plurality of data voltages based on a plurality of present pixel data included in a present frame image to apply the plurality of data voltages to the plurality of data lines. The timing controller controls an operation of the data driver, generates a plurality of decisions by detecting transitions of the plurality of present pixel data, and performs a uniform dynamic capacitance compensation (DCC) based on the plurality of decisions. A present grayscale of each of the plurality of present pixel data increases by a first compensation value, decreases by a second compensation value, or is maintained based on the uniform DCC.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

FIGS. 8A and 8B are diagrams for describing the examples of performing the uniform DCC in FIGS. 6 and 7, respectively.

DETAILED DESCRIPTION OF THE ILLUSTRATED EMBODIMENTS

Figure 1:
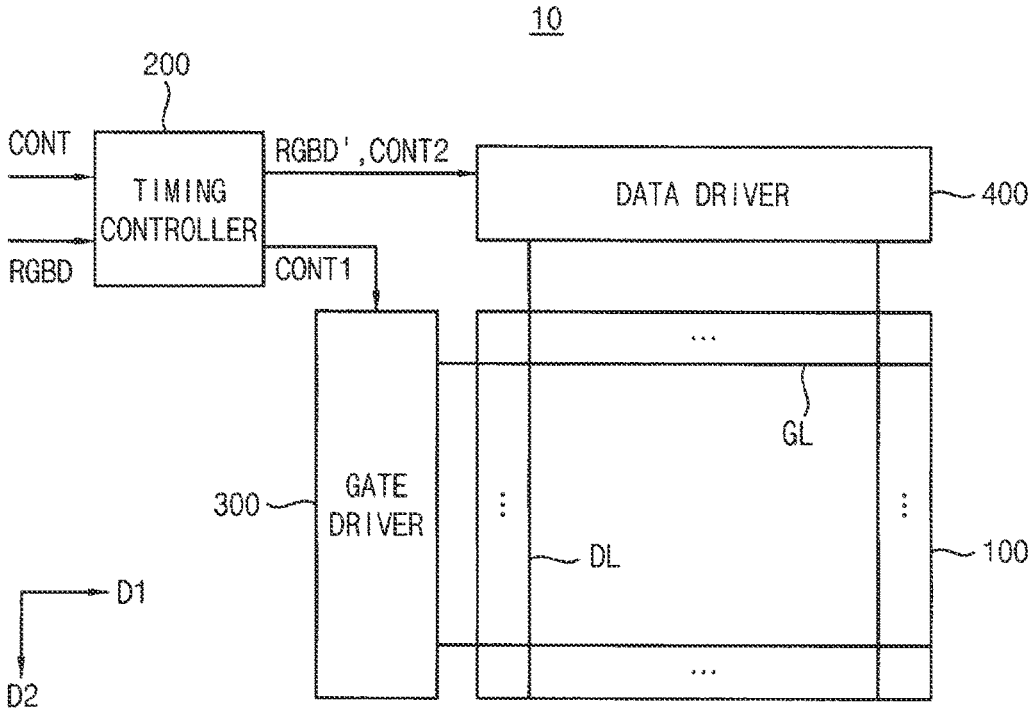
FIG. 1 is a block diagram illustrating a display apparatus according to exemplary embodiments.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

FIG. 1 is a block diagram illustrating a display apparatus according to exemplary embodiments.

Referring to FIG. 1, a display apparatus 10 includes a display panel 100, a timing controller 200, a gate driver 300, and a data driver 400.

The display panel 100 is connected to a plurality of gate lines GL and a plurality of data lines DL. The display panel 100 displays an image having a plurality of grayscales based on output image data RGBD'. The gate lines GL may extend in a first direction D1, and the data lines DL may extend in a second direction D2 crossing (e.g., substantially perpendicular to) the first direction D1.

The display panel 100 may include a plurality of pixels (not illustrated) that are arranged in a matrix. Each pixel may be electrically connected to a respective one of the gate lines GL and a respective one of the data lines DL.

Each pixel may include a switching element (not illustrated), a liquid crystal capacitor (not illustrated), and a storage capacitor (not illustrated). The liquid crystal capacitor and the storage capacitor may be electrically connected to the switching element. For example, the switching element may be a thin film transistor. The liquid crystal capacitor may include a first electrode connected to a pixel electrode and a second electrode connected to a common electrode. A data voltage may be applied to the first electrode of the liquid crystal capacitor. A common voltage may be applied to the second electrode of the liquid crystal capacitor. The storage capacitor may include a first electrode connected to the pixel electrode and a second electrode connected to a storage electrode. The data voltage may be applied to the first electrode of the storage capacitor. A storage voltage may be applied to the second electrode of the storage capacitor. The storage voltage may be substantially equal to the common voltage.

Each pixel may have a rectangular shape. For example, each pixel may have a relatively short side in the first direction D1 and a relatively long side in the second direction D2. The relatively short side of each pixel may be substantially parallel to the gate lines GL. The relatively long side of each pixel may be substantially parallel to the data lines DL.

The timing controller 200 controls an operation of the display panel 100 and operations of the gate driver 300 and the data driver 400. The timing controller 200 receives input image data RGBD and an input control signal CONT from an external device (e.g., a host). The input image data RGBD may include a plurality of input pixel data for the plurality of pixels. Each input pixel data may include red grayscale data R, green grayscale data G, and blue grayscale data B for a respective one of the plurality of pixels. The input control signal CONT may include a master clock signal, a data enable signal, a vertical synchronization signal, a horizontal synchronization signal, etc.

The timing controller 200 generates the output image data RGBD', a first control signal CONT1, and a second control signal CONT2 based on the input image data RGBD and the input control signal CONT.

For example, the timing controller 200 may generate the output image data RGBD' based on the input image data RGBD. The output image data RGBD' may be provided to the data driver 400. In some exemplary embodiments, the output image data RGBD' may be image data that is substantially the same as the input image data RGBD. In other exemplary embodiments, the output image data RGBD' may be compensated image data that is generated by compensating the input image data RGBD. Similarly to the input image data RGBD, the output image data RGBD' may include a plurality of output pixel data for the plurality of pixels.

The timing controller 200 may generate the first control signal CONT1 based on the input control signal CONT. The first control signal CONT1 may be provided to the gate driver 300, and a driving timing of the gate driver 300 may be controlled based on the first control signal CONT1. The first control signal CONT1 may include a vertical start signal, a gate clock signal, etc. The timing controller 200 may generate the second control signal CONT2 based on the input control signal CONT. The second control signal CONT2 may be provided to the data driver 400, and a driving timing of the data driver 400 may be controlled based on the second control signal CONT2. The second control signal CONT2 may include a horizontal start signal, a data clock signal, a data load signal, a polarity control signal, etc.

In addition, the timing controller 200 detects transitions of a plurality of present pixel data included in a present frame image, generates a plurality of decisions based on the transitions of the plurality of present pixel data, and performs a uniform dynamic capacitance compensation (DCC) based on the plurality of decisions. Each present grayscale of each of the plurality of present pixel data increases by a first compensation value, decreases by a second compensation value, or is maintained based on the uniform DCC.

Detailed configurations and operations of the timing controller 200 will be described below with reference to FIGS. 2 through 8.

The gate driver 300 receives the first control signal CONT1 from the timing controller 200. The gate driver 300 generates a plurality of gate signals for driving the gate lines GL based on the first control signal CONT1. The gate driver 300 may sequentially apply the plurality of gate signals to the gate lines GL.

The data driver 400 receives the second control signal CONT2 and the output image data RGBD' from the timing controller 200. The data driver 400 generates a plurality of data voltages (e.g., analog data voltages) based on the second control signal CONT2 and the output image data RGBD' (e.g., digital image data). The data driver 400 may apply the plurality of data voltages to the data lines DL. For example, the data driver 400 may generate the plurality of data voltages based on the plurality of present pixel data included in the present frame image to apply the plurality of data voltages to the plurality of data lines DL.

In some exemplary embodiments, the data driver 400 may include a shift register (not illustrated), a latch (not illustrated), a signal processor (not illustrated), and a buffer (not illustrated). The shift register may output a latch pulse to the latch. The latch may temporarily store the output image data RGBD', and may output the output image data RGBD' to the signal processor. The signal processor may generate the analog data voltages based on the digital output image data RGBD' and may output the analog data voltages to the buffer. The buffer may output the analog data voltages to the data lines DL.

In some exemplary embodiments, the gate driver 300 and/or the data driver 400 may be disposed, e.g., directly mounted, on the display panel 100, or may be connected to the display panel 100 in a tape carrier package ("TCP") type. Alternatively, the gate driver 300 and/or the data driver 400 may be integrated on the display panel 100.

Figure 2:
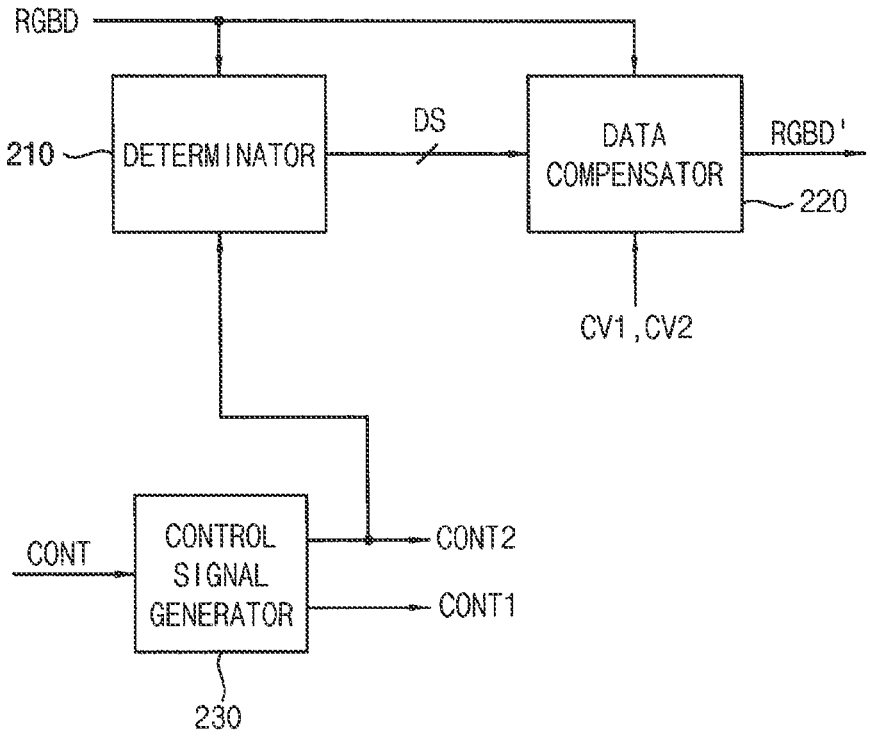
FIG. 2 is a block diagram illustrating an example of a timing controller included in the display apparatus of FIG. 1.

FIG. 2 is a block diagram illustrating an example of a timing controller included in the display apparatus of FIG. 1.

Referring to FIGS. 1 and 2, the timing controller 200 may include a determinator 210, a data compensator 220 and a control signal generator 230. The timing controller 200 is illustrated as being divided into these three elements for convenience of explanation, however, the timing controller 200 need not be so physically divided.

The determinator 210 may detect the transitions of the plurality of present pixel data included in the present frame image to generate the plurality of decisions based on the transitions of the plurality of present pixel data. For example, each of the plurality of present pixel data may have one of a rising transition and a falling transition. In addition, each of the plurality of present pixel data may omit the rising transition and the falling transition. The transition of each of the plurality of present pixel data will be described below with reference to FIGS. 5A, 5B, and 5C.

In some exemplary embodiments, the determinator 210 may generate the plurality of decisions based on the second control signal CONT2 applied to the data driver 400. For example, the determinator 210 may generate the plurality of decisions based on the horizontal start signal included in the second control signal CONT2. The determinator 210 may output a plurality of signals DS corresponding to the plurality of decisions.

The data compensator 220 may receive the input image data RGBD from the external device, and may generate the output image data RGBD' by selectively compensating the input image data RGBD. For example, as described above with reference to FIG. 1, the input image data RGBD may include the plurality of present pixel data corresponding to the present frame image. As will be described below with reference to FIG. 3, the data compensator 220 may perform the uniform DCC for the plurality of present pixel data based on the plurality of decisions, a first compensation value CV1, and a second compensation value CV2. In some exemplary embodiments, the first compensation value CV1 may be substantially the same as the second compensation value CV2. In other exemplary embodiments, the first compensation value CV1 may be different from the second compensation value CV2.

In some exemplary embodiments, the data compensator 220 may further perform an image quality compensation, a spot compensation, and/or an adaptive color correction (ACC) for the input image data RGBD to generate the output image data RGBD'.

The control signal generator 230 may receive the input control signal CONT from the external device, and may generate the first control signal CONT1 for the gate driver 300 and the second control signal CONT2 for the data driver 400 based on the input control signal CONT. The control signal generator 230 may output the first control signal CONT1 to the gate driver 300 and may output the second control signal CONT2 to the data driver 400.

Although not illustrated in FIGS. 1 and 2, the display apparatus 10 may further include a storage that stores the first and second compensation values CV1 and CV2. The storage may be located inside or outside the timing controller 200.

The timing controller 200 included in the display apparatus 10 according to exemplary embodiments may detect the transitions of the plurality of present pixel data included in the present frame image without previous frame image data. In addition, the timing controller 200 may increase some of the present grayscales of the plurality of present pixel data by the same value (e.g., by the first compensation value CV1) and may decrease others of the present grayscales of the plurality of present pixel data by the same value (e.g., by the second compensation value CV2). Accordingly, the display apparatus 10 may omit a frame memory that stores a plurality of previous pixel data included in the previous frame image, and thus, the display apparatus 10 may have a relatively small size.

Figure 3:
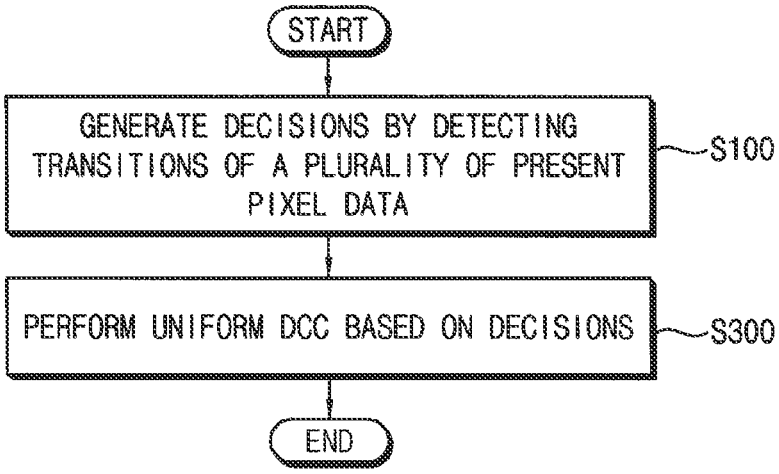
FIG. 3 is a flow chart illustrating a method of operating a display panel according to exemplary embodiments.

FIG. 3 is a flow chart illustrating a method of operating a display panel according to exemplary embodiments.

Referring to FIGS. 1, 2 and 3, in the method of operating the display panel 100 according to exemplary embodiments, the plurality of decisions are generated by detecting the transitions of the plurality of present pixel data included in the present frame image (step S100). The plurality of decisions may be output as the plurality of signals DS.

The uniform DCC is performed based on the plurality of decisions (e.g., based on the plurality of signals DS) (step S300). A present grayscale of each of the plurality of present pixel data increases by the first compensation value CV1, decreases by the second compensation value CV2, or is maintained based on the uniform DCC.

Although not illustrated in FIG. 3, the present frame image may be displayed on the display panel 100 based on the plurality of present pixel data after the uniform DCC is performed on the plurality of present pixel data.

Steps S100 and S300 in FIG. 3 may be performed by the timing controller 200. For example, steps S100 and S300 in FIG. 3 may be performed by the determinator 210 and the data compensator 220 in FIG. 2.

In the method of operating the display panel 100 according to exemplary embodiments, the uniform DCC may be performed based on only the first and second compensation values CV1 and CV2. Accordingly, the display panel 100 may have a relatively improved response speed without increasing a size or the manufacturing cost of the display apparatus 10.

Figure 4:
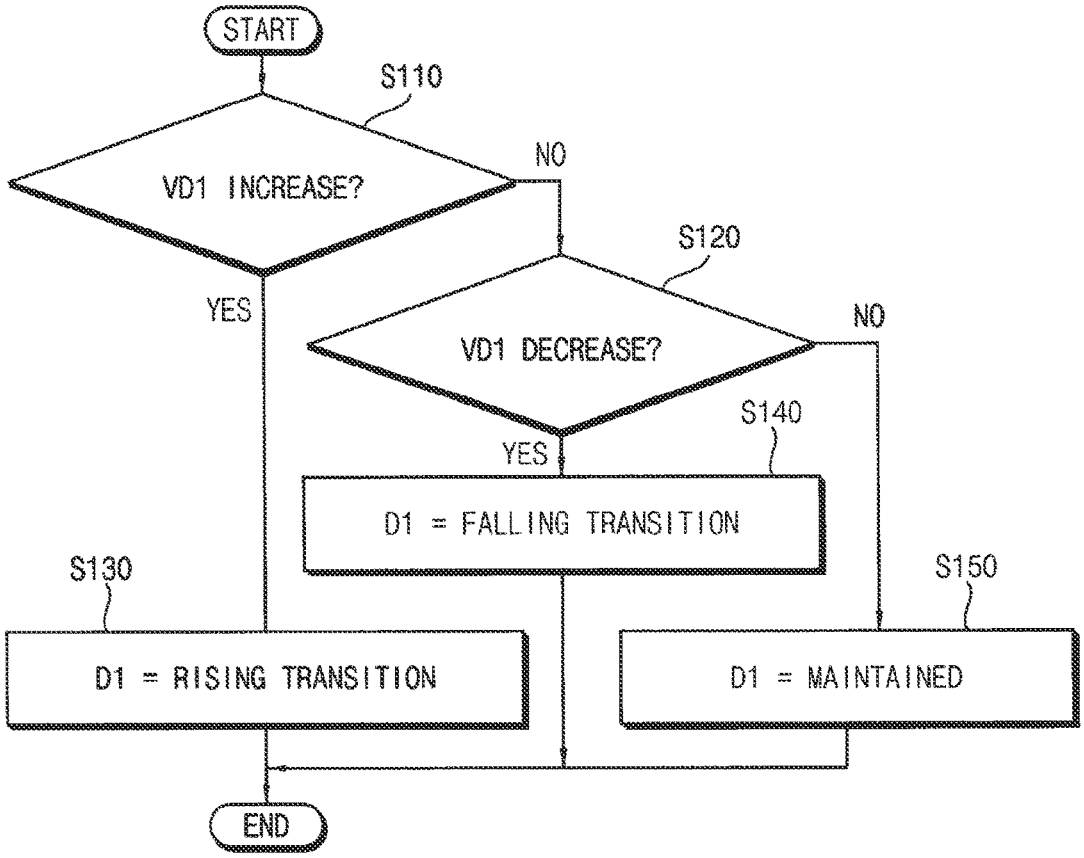
FIG. 4 is a flow chart illustrating an example of generating a plurality of decisions in FIG. 3.
Figure 5A:
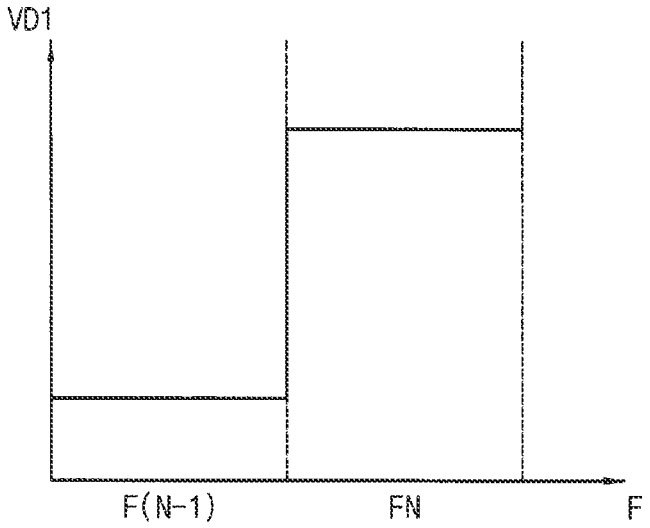
FIGS. 5A, 5B, and 5C are diagrams for describing the example of generating the plurality of decisions of FIG. 4.
Figure 5B:
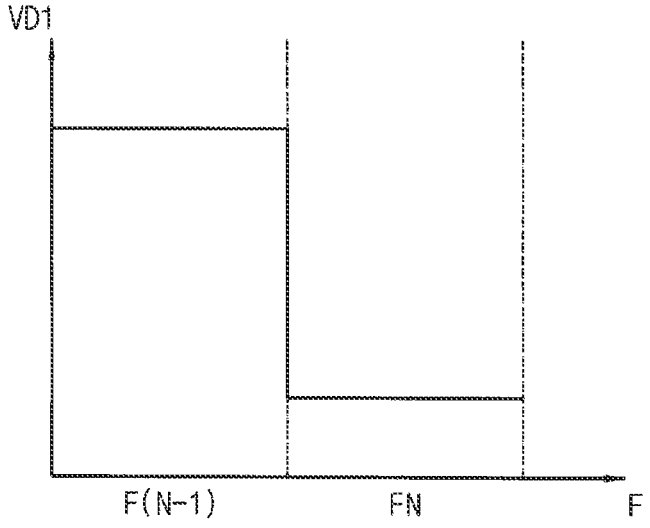
Figure 5C:
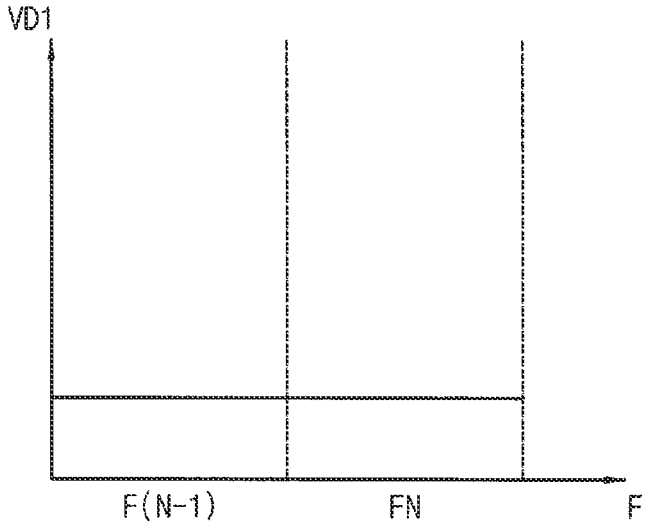

FIG. 4 is a flow chart illustrating an example of generating a plurality of decisions in FIG. 3. FIGS. 5A, 5B, and 5C are diagrams for describing the example of generating the plurality of decisions of FIG. 4.

Referring to FIGS. 3, 4, 5A, 5B, and 5C, in step S100, it may be detected whether a first data voltage VD1 corresponding to first present pixel data D1 among the plurality of present pixel data increases or decreases, and a first decision among the plurality of decisions may be set based on the detection result.

When the first data voltage VD1 increases (step S110: YES), the first decision may be set to indicate that the first present pixel data D1 has the rising transition (step S130). For example, as illustrated in FIG. 5A, when a level of the first data voltage VD1 in a present frame FN is higher than a level of the first data voltage VD1 in a previous frame F(N−1), it may be determined that the first present pixel data D1 has the rising transition.

When the first data voltage VD1 does not increase (step S110: NO), and when the first data voltage VD1 decreases (step S120: YES), the first decision may be set to indicate that the first present pixel data D1 has the falling transition (step S140). For example, as illustrated in FIG. 5B, when a level of the first data voltage VD1 in a present frame FN is lower than a level of the first data voltage VD1 in a previous frame F(N−1), it may be determined that the first present pixel data D1 has the falling transition.

When the first data voltage VD1 does not increase (step S110: NO), and when the first data voltage VD1 does not decrease (step S120: NO), e.g., when the first data voltage VD1 is maintained, the first decision may be set to indicate that the first present pixel data D1 does not have the rising transition and the falling transition (step S150). For example, as illustrated in FIG. 5C, when a level of the first data voltage VD1 in a present frame FN is substantially the same as a level of the first data voltage VD1 in a previous frame F(N−1), it may be determined that the first present pixel data D1 does not have the rising transition and the falling transition.

In some exemplary embodiments, when the display panel 100 in FIG. 1 operates based on a frame inversion scheme and when the first data voltage VD1 has a positive polarity with respect to a common voltage, it may be determined that the first present pixel data D1 has the rising transition. When the display panel in FIG. 1 operates based on the frame inversion scheme and when the first data voltage VD1 has a negative polarity with respect to the common voltage, it may be determined that the first present pixel data D1 has the falling transition. In the frame inversion scheme, a polarity of the first data voltage VD1 may be changed in every frame, and thus, the first present pixel data D1 may have one of the rising and falling transitions in every frame.

For example, in the frame inversion scheme, when the first data voltage VD1 has the positive polarity in the present frame FN, it may be determined that the first data voltage VD1 has the negative polarity in the previous frame F(N−1). In this case, a level of the first data voltage VD1 may be changed similarly to the example illustrated in FIG. 5A, and thus it may be determined that the first present pixel data D1 has the rising transition.

In addition, in the frame inversion scheme, when the first data voltage VD1 has the negative polarity in the present frame FN, it may be determined that the first data voltage VD1 has the positive polarity in the previous frame F(N−1). In this case, a level of the first data voltage VD1 may be changed similarly to the example illustrated in FIG. 5B, and thus, it may be determined that the first present pixel data D1 has the falling transition.

In some exemplary embodiments, it may be determined, based on the second control signal CONT2 in FIG. 1 applied to the data driver 400 in FIG. 1, whether the first present pixel data D1 has the rising transition or the falling transition. For example, based on the horizontal start signal included in the second control signal CONT2 in FIG. 1, it may be determined whether the first data voltage VD1 has the positive polarity or the negative polarity.

Steps S110, S120, S130, S140, and S150 in FIG. 4 may be performed by the timing controller 200 in FIG. 1. For example, steps S110, S120, S130, S140, and S150 in FIG. 4 may be performed by the determinator 210 in FIG. 2.

Although FIG. 4 illustrates the example where the first decision for the first present pixel data D1 is set, decisions for present pixel data other than the first present pixel data D1 may be set similarly to the example of FIG. 4. In other words, steps S110, S120, S130, S140, and S150 in FIG. 4 may be repeated for all of the plurality of present pixel data.

Figure 6:
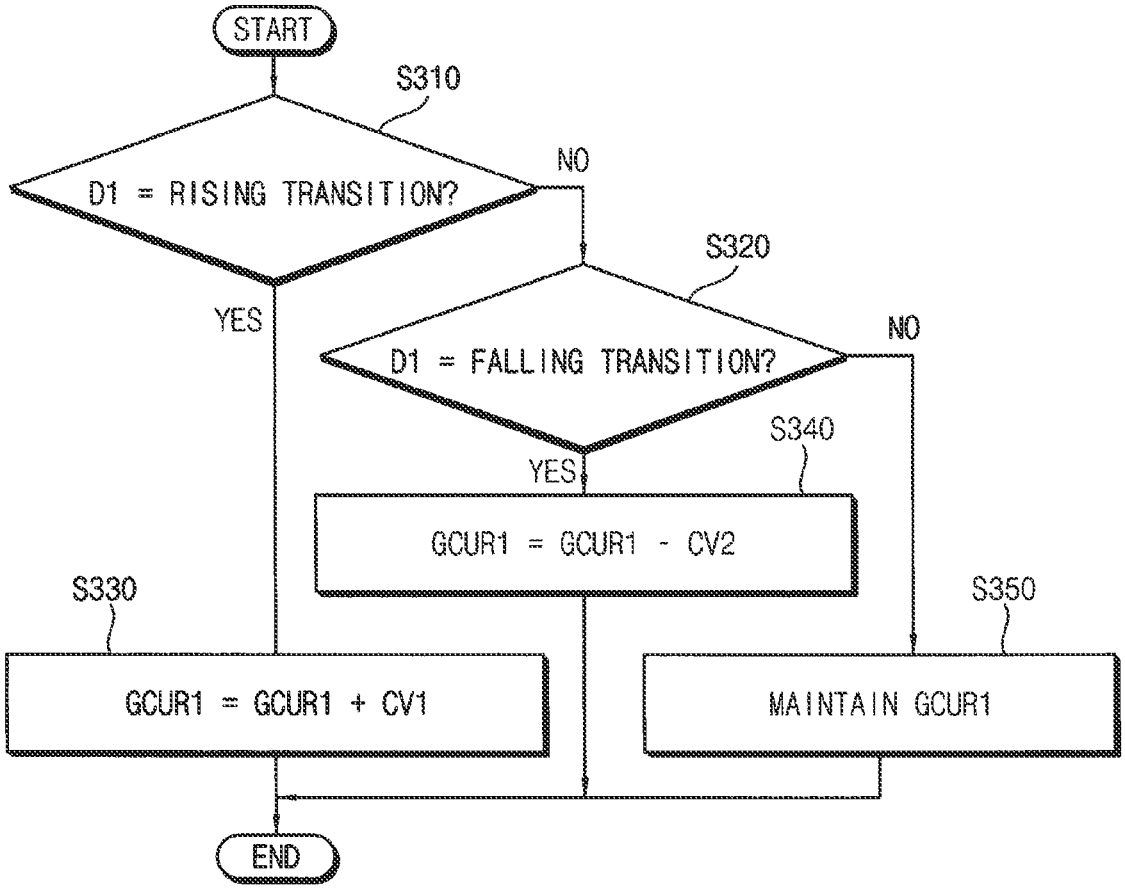
FIG. 6 is a flow chart illustrating an example of performing a uniform DCC in FIG. 3.

FIG. 6 is a flow chart illustrating an example of performing a uniform DCC in FIG. 3.

Referring to FIGS. 3 and 6, in step S300, a first present grayscale GCUR1 of the first present pixel data D1 may be selectively changed (e.g., compensated) based on whether the first present pixel data D1 is transitioned and based on whether the first present pixel data D1 has the rising transition or the falling transition.

When the first present pixel data D1 has the rising transition (step S310: YES), the first present grayscale GCUR1 may increase by the first compensation value CV1 (step S330). When the first present pixel data D1 does not have the rising transition (step S310: NO), and when the first present pixel data D1 has the falling transition (step S320: YES), the first present grayscale GCUR1 may decrease by the second compensation value CV2 (step S340). When the first present pixel data D1 does not have the rising transition (step S310: NO), and when the first present pixel data D1 does not have the falling transition (step S320: NO), e.g., when the first present pixel data D1 is not transitioned, the first present grayscale GCUR1 may be maintained (step S350).

In some exemplary embodiments, as will be described below with reference to FIG. 8A, the first compensation value CV1 may be substantially the same as the second compensation value CV2. In this case, the uniform DCC may be performed based on a single compensation value. In other exemplary embodiments, as will be described below with reference to FIG. 8B, the first compensation value CV1 may be different from the second compensation value CV2. In this case, the uniform DCC may be performed based on two compensation values.

Figure 7:
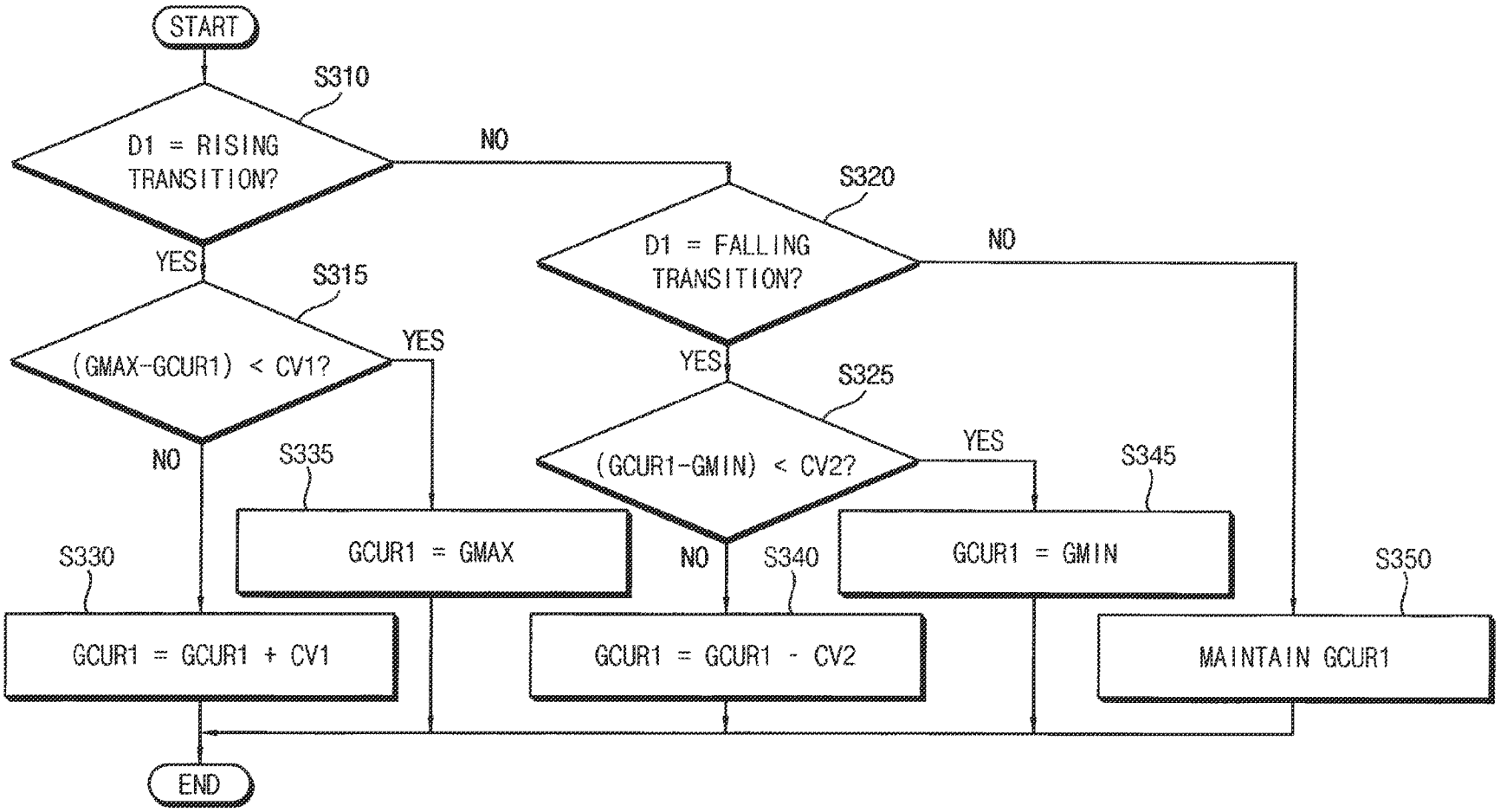
FIG. 7 is a flow chart illustrating another example of performing the uniform DCC in FIG. 3.

FIG. 7 is a flow chart illustrating another example of performing the uniform DCC in FIG. 3.

Referring to FIGS. 3 and 7, in step S300, the first present grayscale GCUR1 of the first present pixel data D1 may be selectively changed (e.g., compensated) based on whether the first present pixel data D1 is transitioned, based on whether the first present pixel data D1 has the rising transition or the falling transition, and based on a value of the first present grayscale GCUR1.

When the first present pixel data D1 has the rising transition (step S310: YES), and when a first difference between a maximum grayscale GMAX and the first present grayscale GCUR1 is equal to or greater than the first compensation value CV1 (step S315: NO), the first present grayscale GCUR1 may increase by the first compensation value CV1 (step S330). When the first present pixel data D1 has the rising transition (step S310: YES), and when the first difference is smaller than the first compensation value CV1 (step S315: YES), the first present grayscale GCUR1 may be changed into the maximum grayscale GMAX (step S335).

When the first present pixel data D1 does not have the rising transition (step S310: NO), when the first present pixel data D1 has the falling transition (step S320: YES), and when a second difference between the first present grayscale GCUR1 and a minimum grayscale GMIN is equal to or greater than the second compensation value CV2 (step S325: NO), the first present grayscale GCUR1 may decrease by the second compensation value CV2 (step S340). When the first present pixel data D1 does not have the rising transition (step S310: NO), when the first present pixel data D1 has the falling transition (step S320: YES), and when the second difference is smaller than the second compensation value CV2 (step S325: YES), the first present grayscale GCUR1 may be changed into the minimum grayscale GMIN (step S345).

When the first present pixel data D1 does not have the rising transition (step S310: NO), and when the first present pixel data D1 does not have the falling transition (step S320: NO), e.g., when the first present pixel data D1 is not transitioned, the first present grayscale GCUR1 may be maintained (step S350).

Steps S310, S320, S330, S340, and S350 in FIG. 7 may be substantially the same as steps S310, S320, S330, S340, and S350 in FIG. 6, respectively.

Step S310, S320, S330, S340, and S350 in FIG. 6, or steps S310, S315 S320, S325, S330, S335, S340, S345, and S350 in FIG. 7 may be performed by the timing controller 200 in FIG. 1. For example, steps S310, S320, S330, S340, and S350 in FIG. 6, or steps S310, S315 S320, S325, S330, S335, S340, S345 and S350 in FIG. 7 may be performed by the data compensator 220 in FIG. 2.

Although FIGS. 6 and 7 illustrate the examples where the first present grayscale GCUR1 of the first present pixel data D1 is selectively changed, present grayscales of present pixel data other than the first present pixel data D1 may be selectively changed similarly to the examples of FIGS. 6 and 7. In other words, steps S310, S320, S330, S340, and S350 in FIG. 6, or steps S310, S315 S320, S325, S330, S335, S340, S345, and S350 in FIG. 7 may be repeated for all of the plurality of present pixel data.

FIGS. 8A and 8B are diagrams for describing the examples of performing the uniform DCC in FIGS. 6 and 7.

FIG. 8A is a table illustrating compensations for present grayscales of the plurality of present pixel data based on the uniform DCC when the first compensation value CV1 is substantially the same as the second compensation value CV2. FIG. 8B is a table illustrating compensations for present grayscales of the plurality of present pixel data based on the uniform DCC when the first compensation value CV1 is different from the second compensation value CV2. In FIGS. 8A and 8B, GA represents the previous grayscales of the plurality of previous pixel data in the previous frame. GB represents the present grayscales of the plurality of present pixel data in the present frame before the uniform DCC is performed. It is assumed that the display panel 100 in FIG. 1 displays 1024 grayscales, which range from about 0 to about 1023.

Referring to FIG. 8A, when the present grayscale is substantially the same as the previous grayscale, the present grayscale may not be compensated (e.g., may not increase or decrease) and may be maintained (e.g., areas filled with diagonal lines in FIG. 8A). For example, when the previous grayscale is about 256 grayscale and when the present grayscale is about 256 grayscale, the present grayscale may be maintained at about 256 grayscale.

When the present grayscale is different from the previous grayscale, the present grayscale may be compensated (e.g., may increase or decrease). For example, when the previous grayscale is about 128 grayscale and when the present grayscale is about 256 grayscale, it may be determined that the present pixel data may have the rising transition. In this case, the present grayscale may increase by the first compensation value CV1, and thus, the present grayscale may be compensated to about 356 grayscale. When the previous grayscale is about 512 grayscale and when the present grayscale is about 256 grayscale, it may be determined that the present pixel data may have the falling transition. In this case, the present grayscale may decrease by the second compensation value CV2, and thus, the present grayscale may be compensated to about 156 grayscale. In the example of FIG. 8A, each of the first and second compensation values CV1 and CV2 may be about 100.

In addition, the present grayscale may be changed into one of the maximum grayscale (e.g., about 1023 grayscale) and the minimum grayscale (e.g., about 0 grayscale) based on a difference between the maximum grayscale and the present grayscale and based on a difference between the present grayscale and the minimum grayscale. For example, when the previous grayscale is about 256 grayscale and when the present grayscale is about 64 grayscale, it may be determined that the present pixel data may have the falling transition. In this case, since the difference between the present grayscale and the minimum grayscale is smaller than the second compensation value CV2 (e.g., about 100), the present grayscale may be changed into the minimum grayscale (e.g., about 0 grayscale). When the previous grayscale is about 512 grayscale and when the present grayscale is about 960 grayscale, it may be determined that the present pixel data may have the rising transition. In this case, because the difference between the maximum grayscale and the present grayscale is smaller than the first compensation value CV1 (e.g., about 100), the present grayscale may be changed into the maximum grayscale (e.g., about 1023 grayscale).

Referring to FIG. 8B, when the present grayscale is substantially the same as the previous grayscale, the present grayscale may not be compensated (e.g., may not increase or decrease) and may be maintained (e.g., areas filled with diagonal lines in FIG. 8B). For example, when the previous grayscale is about 256 grayscale and when the present grayscale is about 256 grayscale, the present grayscale may be maintained at about 256 grayscale. The example of FIG. 8B may be substantially the same as the example of FIG. 8A, except that the first compensation value CV1 is different from the second compensation value CV2 in FIG. 8B.

When the present grayscale is different from the previous grayscale, the present grayscale may be compensated (e.g., may increase or decrease). For example, when the previous grayscale is about 128 grayscale and when the present grayscale is about 256 grayscale, it may be determined that the present pixel data may have the rising transition. In this case, the present grayscale may increase by the first compensation value CV1, and thus, the present grayscale may be compensated to about 356 grayscale. When the previous grayscale is about 512 grayscale and when the present grayscale is about 256 grayscale, it may be determined that the present pixel data may have the falling transition. In this case, the present grayscale may decrease by the second compensation value CV2, and thus, the present grayscale may be compensated to about 176 grayscale. In the example of FIG. 8B, the first compensation value CV1 may be about 100, and the second compensation value CV2 may be about 80.

In some exemplary embodiments, at least one selected from the first compensation value CV1 and the second compensation value CV2 may be variable. For example, at least one selected from the first compensation value CV1 and the second compensation value CV2 may be varied based on a configuration and/or a driving scheme of the display panel 100 in FIG. 1. For another example, at least one selected from the first compensation value CV1 and the second compensation value CV2 may be varied based on some portion of the previous frame image. In this case, the display apparatus 10 in FIG. 1 may include a line memory (not illustrated) that stores at least one line of the previous frame image.

Although the exemplary embodiments are described based on a specific example in which the compensation operation is performed for a specific grayscale (e.g., about 256 grayscale), the exemplary embodiments will be employed such that the compensation operation is performed for various grayscales.

The above described exemplary embodiments may be used in a display apparatus and/or a system including the display apparatus, such as a mobile phone, a smart phone, a personal digital assistants (PDA), a portable multimedia player (PMP), a digital camera, a digital television, a set-top box, a music player, a portable game console, a navigation device, a personal computer (PC), a server computer, a workstation, a tablet computer, a laptop computer, a smart card, a printer, etc. In the method of operating the display panel according to exemplary embodiments, the transitions of the plurality of present pixel data included in a present frame image may be detected without a previous frame image. In addition, some of the present grayscales of the plurality of present pixel data may increase by the same value, and others of the present grayscales of the plurality of present pixel data may decrease by the same value. Accordingly, the display apparatus may omit a frame memory that stores a plurality of previous pixel data included in the previous frame image, and thus, the display apparatus may have a relatively small size. In addition, the display panel may have a relatively improved response speed without increasing the size or manufacturing cost of the display apparatus.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. A method of operating a display panel, the method comprising:

generating a plurality of decisions by detecting transitions of a plurality of present pixel data included in a present frame image; and performing a uniform dynamic capacitance compensation (DCC) based on the plurality of decisions, wherein:

a present grayscale of each of the plurality of present pixel data increases by a first compensation value, decreases by a second compensation value, or is maintained based on the uniform DCC;

in response to an increase in a first data voltage corresponding to first present pixel data among the plurality of present pixel data, setting a first decision among the plurality of decisions to indicate that the first present pixel data has a rising transition;

in response to a decrease in the first data voltage, setting the first decision to indicate that the first present pixel data has a falling transition;

when the display panel operates based on a frame inversion scheme and when the first data voltage has a positive polarity with respect to a common voltage, it is determined that the first present pixel data has the rising transition; and when the display panel operates based on the frame inversion scheme and when the first data voltage has a negative polarity with respect to the common voltage, it is determined that the first present pixel data has the falling transition.

2. The method of claim 1, wherein whether the first present pixel data has the rising transition or the falling transition is determined based on a control signal applied to a data driver for driving the display panel.

3. The method of claim 1, wherein generating the plurality of decisions further comprises setting the first decision to indicate that the first present pixel data does not have the rising transition and does not have the falling transition when the first data voltage is maintained.

4. The method of claim 1, wherein performing the uniform DCC comprises:

increasing a first present grayscale of the first present pixel data by the first compensation value when the first present pixel data has the rising transition; and decreasing the first grayscale of the first present pixel data by the second compensation value when the first present pixel data has the falling transition.

5. The method of claim 4, wherein performing the uniform DCC further comprises changing the first present grayscale into a maximum grayscale when the first present pixel data has the rising transition and when a difference between the maximum grayscale and the first present grayscale is smaller than the first compensation value.

6. The method of claim 4, wherein performing the uniform DCC further comprises changing the first present grayscale into a minimum grayscale when the first present pixel data has the falling transition and when a difference between the first present grayscale and the minimum grayscale is smaller than the second compensation value.

7. The method of claim 4, wherein performing the uniform DCC further comprises maintaining the first present grayscale when the first present pixel data does not have the rising transition and does not have the falling transition.

8. The method of claim 1, wherein the first compensation value is substantially equal to the second compensation value.

9. The method of claim 1, wherein the first compensation value is not equal to the second compensation value.

10. A display apparatus comprising:

a display panel comprises a plurality of pixels that are connected to a plurality of gate lines and a plurality of data lines;

a data driver configured to generate a plurality of data voltages based on a plurality of present pixel data included in a present frame image to apply the plurality of data voltages to the plurality of data lines; and a timing controller configured to control an operation of the data driver, configured to generate a plurality of decisions by detecting transitions of the plurality of present pixel data, and configured to perform a uniform dynamic capacitance compensation (DCC) based on the plurality of decisions, wherein:

a present grayscale of each of the plurality of present pixel data increases by a first compensation value, decreases by a second compensation value, or is maintained based on the uniform DCC;

in response to an increase in a first data voltage corresponding to first present pixel data among the plurality of present pixel data, the timing controller sets a first decision among the plurality of decisions to indicate that the first present pixel data has a rising transition;

in response to a decrease in the first data voltage, the timing controller sets the first decision to indicate that the first present pixel data has a falling transition;

the timing controller determines that the first present pixel data has the rising transition when the display panel operates based on a frame inversion scheme and when the first data voltage has a positive polarity with respect to a common voltage; and the timing controller determines that the first present pixel data has the falling transition when the display panel operates based on the frame inversion scheme and when the first data voltage has a negative polarity with respect to the common voltage.

11. The display apparatus of claim 10, wherein the timing controller determines whether the first present pixel data has the rising transition or the falling transition based on a control signal applied to the data driver.

12. The display apparatus of claim 10, wherein the timing controller sets the first decision to indicate that the first present pixel data does not have the rising transition and does not have the falling transition when the first data voltage is maintained.

13. The display apparatus of claim 10, wherein:

the timing controller increases a first present grayscale of the first present pixel data by the first compensation value when the first present pixel data has the rising transition; and the timing controller decreases the first grayscale of the first present pixel data by the second compensation value when the first present pixel data has the falling transition.

14. The display apparatus of claim 13, wherein when the first present pixel data has the rising transition and a difference between a maximum grayscale and the first present grayscale is smaller than the first compensation value, the timing controller changes the first present grayscale into the maximum grayscale.

15. The display apparatus of claim 13, wherein when the first present pixel data has the falling transition and a difference between the first present grayscale and a minimum grayscale is smaller than the second compensation value, the timing controller changes the first present grayscale into the minimum grayscale.

16. The display apparatus of claim 13, wherein the timing controller maintains the first present grayscale when the first present pixel data does not have the rising transition and does not have the falling transition.

* * * * *